US009102425B2

(12) United States Patent
Turesson

(10) Patent No.: US 9,102,425 B2
(45) Date of Patent: Aug. 11, 2015

(54) APPARATUS FOR REFORMING A MATERIAL WEB

(75) Inventor: Mats Turesson, Staffanstorp (SE)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 1055 days.

(21) Appl. No.: 12/741,106

(22) PCT Filed: Nov. 3, 2008

(86) PCT No.: PCT/SE2008/000622
§ 371 (c)(1),
(2), (4) Date: May 3, 2010

(87) PCT Pub. No.: WO2009/067065
PCT Pub. Date: May 28, 2009

(65) Prior Publication Data

US 2011/0120063 A1 May 26, 2011

(30) Foreign Application Priority Data

Nov. 21, 2007 (SE) ..... 0702568

(51) Int. Cl.

| | |
|---|---|
| ***B65B 61/18*** | (2006.01) |
| ***B65B 9/20*** | (2012.01) |
| ***B65B 9/22*** | (2006.01) |
| ***B65B 9/207*** | (2012.01) |
| ***B65B 9/213*** | (2012.01) |

(52) U.S. Cl.
CPC ..... *B65B 9/22* (2013.01); *B65B 9/2035* (2013.01); *B65B 9/207* (2013.01); *B65B 61/186* (2013.01)

(58) Field of Classification Search
CPC ..... B65B 61/186; B65B 9/20; B65B 9/2014; B65B 9/2028; B65B 9/2035; B65B 9/22; B65B 9/207; B65B 9/213
USPC ..... 53/551, 133.2, 389.2, 389.4
See application file for complete search history.

(56) References Cited

U.S. PATENT DOCUMENTS

| | | | | |
|---|---|---|---|---|
| 3,444,792 | A | 5/1969 | Thesing et al. | |
| 4,566,250 | A * | 1/1986 | Matsumura et al. | 53/500 |
| 5,067,311 | A | 11/1991 | Andersson | |

(Continued)

FOREIGN PATENT DOCUMENTS

| | | |
|---|---|---|
| EP | 0 427 027 A1 | 5/1991 |
| EP | 0 903 292 A1 | 3/1999 |

(Continued)

OTHER PUBLICATIONS

Mexican Official Action dated May 23, 2013 issued in the corresponding Mexican Patent Application No. MX/a/2010/005452 and English language translation.

(Continued)

*Primary Examiner* — Thanh Truong
*Assistant Examiner* — Praachi M Pathak
(74) *Attorney, Agent, or Firm* — Buchanan Ingersoll & Rooney PC

(57) ABSTRACT

The present invention relates to an apparatus for reforming of a web of flexible packaging material into tube form by rotatable forming rollers which define a material opening. The apparatus is at least one of the forming rollers is displaceable in relation to the material web when an opening device disposed on the material web passes through the material opening.

16 Claims, 9 Drawing Sheets

(56) References Cited

U.S. PATENT DOCUMENTS

Figure 1:
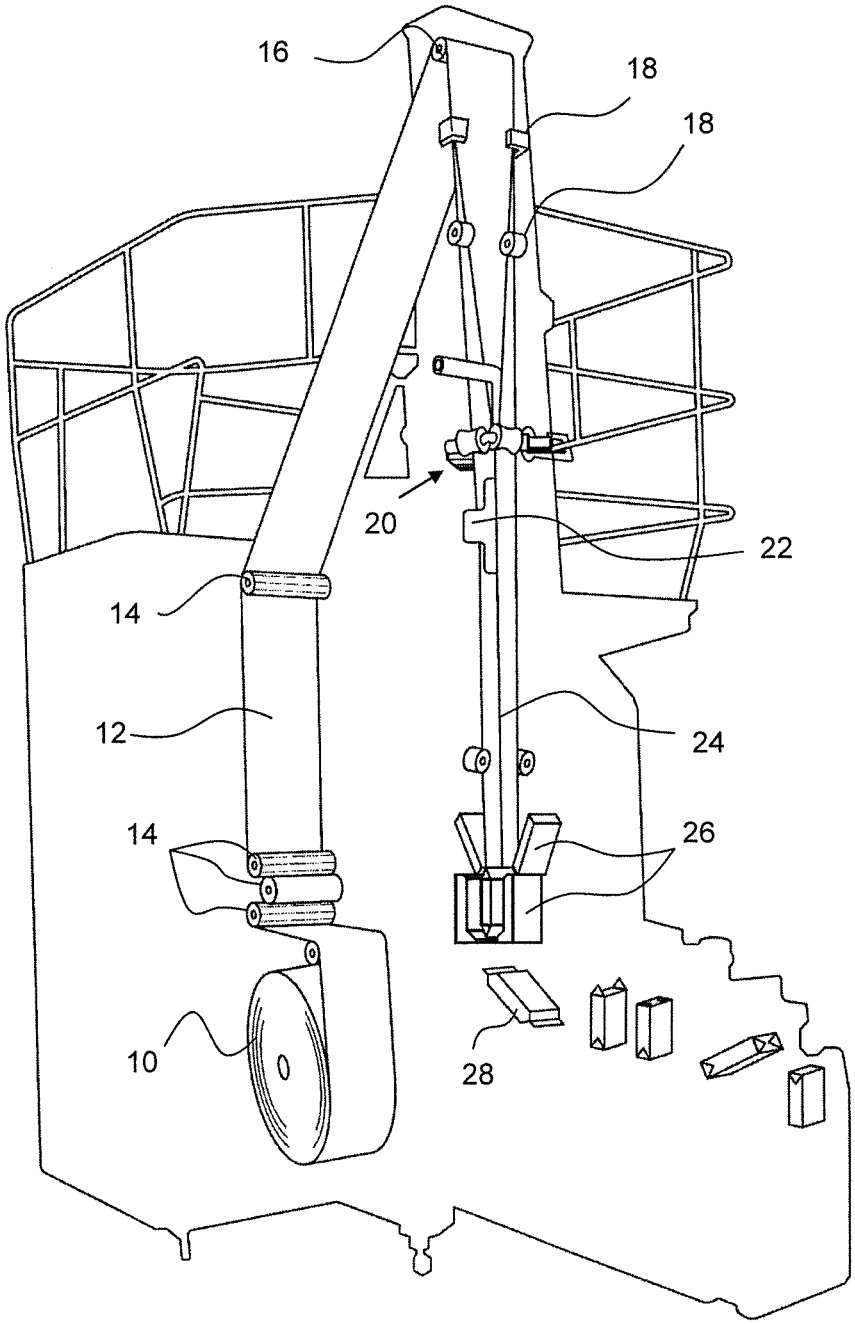

| | | | | |
|---|---|---|---|---|
| 6,052,970 | A * | 4/2000 | Fujimoto et al. | 53/451 |
| 6,386,851 | B1 | 5/2002 | Gustafson | |
| 7,007,440 | B2 | 3/2006 | Kinoshita et al. | |
| 7,448,189 | B2 | 11/2008 | Kinoshita et al. | |
| 2005/0016124 | A1 | 1/2005 | Kinoshita et al. | |
| 2006/0026929 | A1 | 2/2006 | Kinoshita et al. | |

FOREIGN PATENT DOCUMENTS

| | | | |
|---|---|---|---|
| EP | 1 468 914 | A1 | 10/2004 |
| JP | 57-068334 | A | 4/1982 |
| JP | 2006-290434 | A | 10/2006 |
| RU | 1806067 | A3 | 3/1993 |
| WO | WO 98/18609 | A1 | 5/1998 |
| WO | 2006-073339 | A1 | 7/2006 |

OTHER PUBLICATIONS

European Supplementary Search Report dated May 6, 2013 issued in the corresponding European Patent Application No. 08852160.

Japanese Official Action dated Nov. 26, 2012 issued in the corresponding Japanese Patent Application No. 2010-534908 and English language translation.

International Search Report issued by the Swedish Patent Office on Feb. 23, 2009 as the International Searching Authority in International Application No. PCT/SE2008/000622.

* cited by examiner

APPARATUS FOR REFORMING A MATERIAL WEB

TECHNICAL FIELD

The present invention relates to an apparatus for reforming of a web of flexible packaging material into tube form by means of rotatable forming rollers which define a material opening.

BACKGROUND ART

In a number of today's packing and filling machines for manufacturing, for example, parallelepipedic packaging containers substantially for liquid foods, a web-shaped, flexible packaging material is progressively reformed into tube form in that both of its longitudinal edges are brought together so as to overlap and are sealed. Thereafter, the desired contents are fed to the packaging material tube and this is transversely sealed at uniform intervals in transverse sealing zones. The sealed-off sections of the tube thus filled with their contents are thereafter separated from the tube by means of incisions in the sealing zones and are formed, where applicable, by folding to the desired geometric configuration depending on how the two seals disposed transversely of the longitudinal direction of the tube have been oriented. The packaging container may, for example, be given parallelepipedic configuration.

The reforming of the originally planar packaging material into tube form takes place with the aid of a number of forming apparatuses which int.al. include forming rollers. These forming rollers are disposed annularly around a circular opening for the packaging material. The forming rollers are freely rotatable, and together force the packaging material to assume a substantially circular cross section, so that their longitudinal edges can be sealed to one another. At the last of the forming devices, the material tube has attained its final cross section and the longitudinal sealing can be carried out.

Such a forming apparatus is described, for instance in European Patent Specification EP 0 427 027.

Recently, it has become common practice to provide packaging containers with opening devices of the type comprising a pouring opening which is defined by a neck which, on its outside is provided with threading, and a cap which is disposed to be able to be threaded on and off the neck. The opening device may also include a tear-off membrane which initially covers the pouring opening and is an integral part of the neck. Many of these opening devices are applied in their entirety, by gluing or hot-melt welding, on the packaging containers when these are finally formed. However, technology is in place to injection mould the neck direct on the planar material web in holes punched specifically for this purpose. This technology is described, for instance in International Patent Publication WO 98/18609 and in U.S. Pat. No. 6,386,851. In the case involving opening devices of the type described by way of introduction, this technology is employed to injection mould the neck as well as the membrane direct on the web before the tube forming, while the cap is not applied until after the final forming of the packaging container.

On use of relatively planar opening devices, for example those which include a folding lid, and which lack the previously described neck, the above-considered technique necessitates no or extremely slight modifications to the tube forming apparatuses. Opening devices with necks and membrane, which may project roughly 10 mm out from the material web, are however not as simple to handle in the prior art forming apparatuses. As was mentioned previously, the lower, last of the forming apparatuses is dimensioned in response to the desired final diameter of the material tube and it is there that the longitudinal sealing operation takes place. When the material web with a projecting opening device is thereby to pass through said forming apparatus, the tube is forced to bulge inwards towards the centre of the tube, possibly in combination with the opening device being compressed together somewhat in order for the opening device to be able to pass. This may result in undesirable stresses on both the web and the opening device. In the upper forming apparatuses, this problem is resolved in that the roller that is placed in the path of the opening devices is permanently removed. One negative effect of this solution is that, because of the inherent rigidity of the material web, there will be a certain outward flexing of the tube in the gap. This is of no consequence in the upper early forming apparatuses. However, such an outward flexing is not desirable at the lowermost, last forming apparatus, since, with the forming of the longitudinal seal, it is important at this position to be able to maintain the cross-sectional configuration unchanged.

SUMMARY OF THE INVENTION

Thus, one object of the present invention is to realise an apparatus for reforming of a web of flexible packaging material into tube form by means of rotatable forming rollers that define a material opening, the apparatus permitting opening devices placed on the web to pass through the material opening with a minimum effect on the cross section of the tube configuration.

This object is attained by means of an apparatus which is characterised in that at least one of the forming rollers is displacable in relation to the material web when said opening device passes through said material opening. By temporarily displacing the forming roller or rollers that lie in the path of the opening device, the cross section of the material tube can be kept substantially unchanged, which ensures that a uniform longitudinal seal may be made with good result and which effectively reduces the risk that the opening device is forced against the material tube in such a manner that deformations occur in the paper, which could cause folds and leakage between the opening device and the material tube. Similarly, the risk that the opening device be damaged is effectively reduced.

In one currently preferred embodiment of the present invention, said displacable forming roller is that one of the forming rollers which will lie in the path of the opening device through the material opening.

In a further currently preferred embodiment of the present invention, said forming roller is displacable from a first position where it is contact with the material web to a second position where it is not in contact with the material web.

In still a further currently preferred embodiment of the present invention, said forming roller is rotatable about its own axis and is pivotally disposed about an axis which extends through a centre of rotation, and the displacement of the forming roller from the first position to the second position thereby consists of a pivotal movement about said centre of rotation and axis. By such means, the forming roller may effectively be displaced from its position between the other forming rollers.

In yet a further currently preferred embodiment of the present invention, said pivotal movement is initiated in that said opening device comes into contact with and urges against the forming roller. As a result, the time when the material tube lacks support from the forming roller can be kept very brief, which reduces the risk that the material tube be flexed out in the gap that occurs when the forming roller is located in its second position.

In still a further currently preferred embodiment of the present invention, said pivotal movement is permitted and regulated by an elastic element in communication with the forming roller and as a result of the elastic tensioning, the forming roller is disposed to completely return from the second position to the first position when the contact with the opening device ceases. A solution of this type is uncomplicated, operationally reliable and can be controlled purely mechanically.

According to one embodiment of the present invention, the second position of the forming roller is defined by an arrest member which restricts the pivotal movement of the forming roller. Accordingly, the forming roller is not permitted to assume a maximum position in the form of the maximum deviation from the first position which could theoretically occur in that the opening device acts on the forming roller. By such a design, the striving of the forming roller to return to the first position when the opening device has passed will be increased. Furthermore, the possibilities of the tube to bulge outwards or flex outwards in the area of the forming roller are reduced. Naturally, such a design may also entail that the pressure on the opening device against the tube increases slightly. The arrest member must however be designed and disposed in such a manner that the pressure on the opening device will be so slight that there is no risk of any appreciable deformation of the packaging tube.

In still a further currently preferred embodiment of the present invention, said forming roller is suspended so that it will be displaceable when a force or force component in the direction of advancement of the material web initially acts on the forming roller, the force or force component occurring on contact between the forming roller and the opening device, while the forming roller maintains its position if it is substantially only affected by a force or force component deriving from the material web and directed transversely of the direction of advancement of the material web. Given the inherent rigidity of the packaging material, the material tube strives to return to web shape. It is the forming rollers which ensure that the cross section of the tube is maintained. As a result, it would be most inappropriate if the forming roller could be affected by the force from the material tube. Then, nothing would have been gained, and it would not have been possible to maintain the cross section. It is also the intention to attain an arrangement where no major force should be necessary from the opening device in order to displace the forming roller, i.e. the forming roller should readily give way when an opening device comes into contact with it. Otherwise, there is a risk that the material tube be instead flexed inwards or that the opening device be damaged. For example, an arrangement where the elastic element also constantly works to hold back the material tube could not have been made easily movable to a sufficient degree. Instead, the entire problem structure is resolved by making the apparatus rigid in one direction and resiliently yieldable in another direction.

In one currently preferred embodiment of the present invention, the forming rollers are rotatably journalled in a substantially annular bracket.

In yet a further currently preferred embodiment of the present invention, the displaceable forming roller is pivotally disposed about said centre of rotation by means of an anchorage, said anchorage being rotatably journalled in the annular bracket in said centre of rotation, the elastic element being secured in the annular bracket as well as in the anchorage on a first side of said centre of rotation, and said forming roller being rotatably journalled in the anchorage on a second side of said centre of rotation. By such means, two counteracting torques are readily achieved about the centre of rotation.

In still a further currently preferred embodiment of the present invention, the anchorage is U-shaped, the forming roller is journalled in the outer, free sections of the shanks of the U-shape, the elastic element is secured in the central section of the U-shape between the shanks, and the annular bracket includes fixed shafts which are journalled in said centre of rotation of the anchorage. This is an efficient and mechanically simple solution for realising the displacement of the forming roller.

In yet a further currently preferred embodiment of the present invention, the elastic element is a tension spring. Tension springs are economical and are available in different lengths and with different spring constants, with the result that they are easy to work with.

In still a further embodiment of the present invention, said forming roller is in communication with displacement means which are in communication with means for detecting said opening device, and the forming roller is disposed to be displaced by said displacement means when said opening device approaches the material opening. This is one alternative method of realising the displacement of the forming roller.

In yet a further currently preferred embodiment of the present invention, said displacement means displace the forming roller from the first position to the second position immediately before the opening device reaches the material opening, and said displacement means displace the forming roller back to the first position when the opening device has passed through the material opening. By such means, no contact occurs between the opening device and the forming roller, which could prove to be favourable in certain cases, for example if the opening device is still very hot and thereby fragile after the injection moulding operation, or if the design of the opening device entails that it includes parts which could readily be damaged on contact with the forming roller.

BRIEF DESCRIPTION OF THE ACCOMPANYING DRAWINGS

Figure 2:
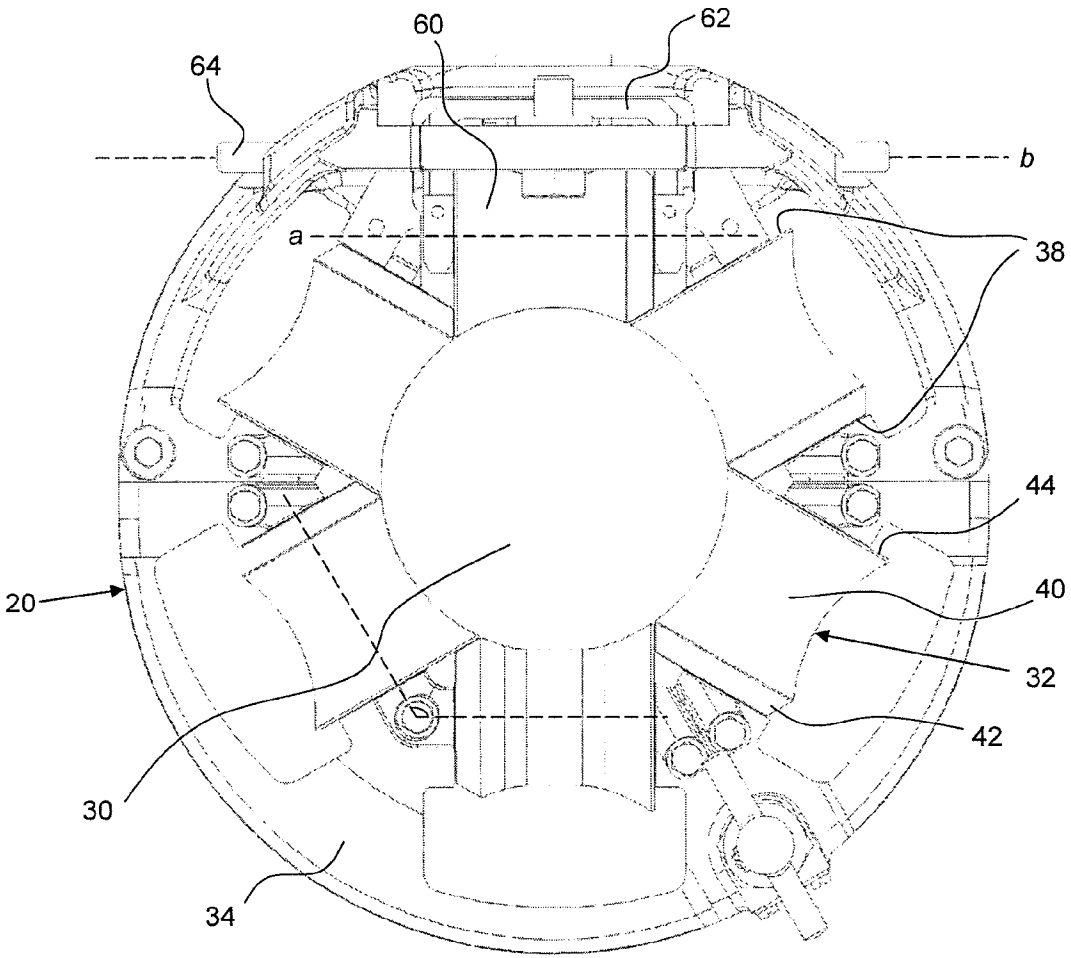
Figure 3:
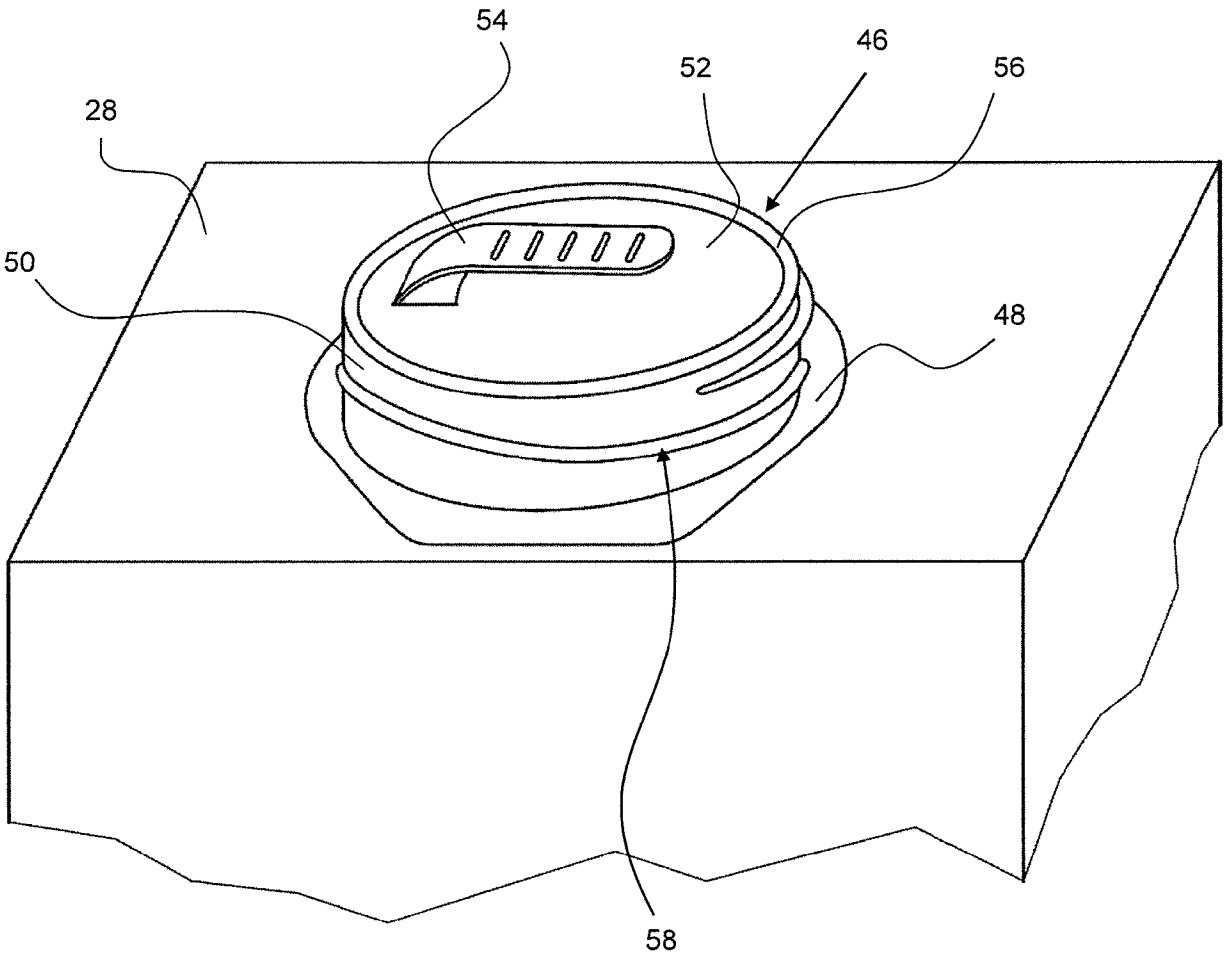
Figure 4A:
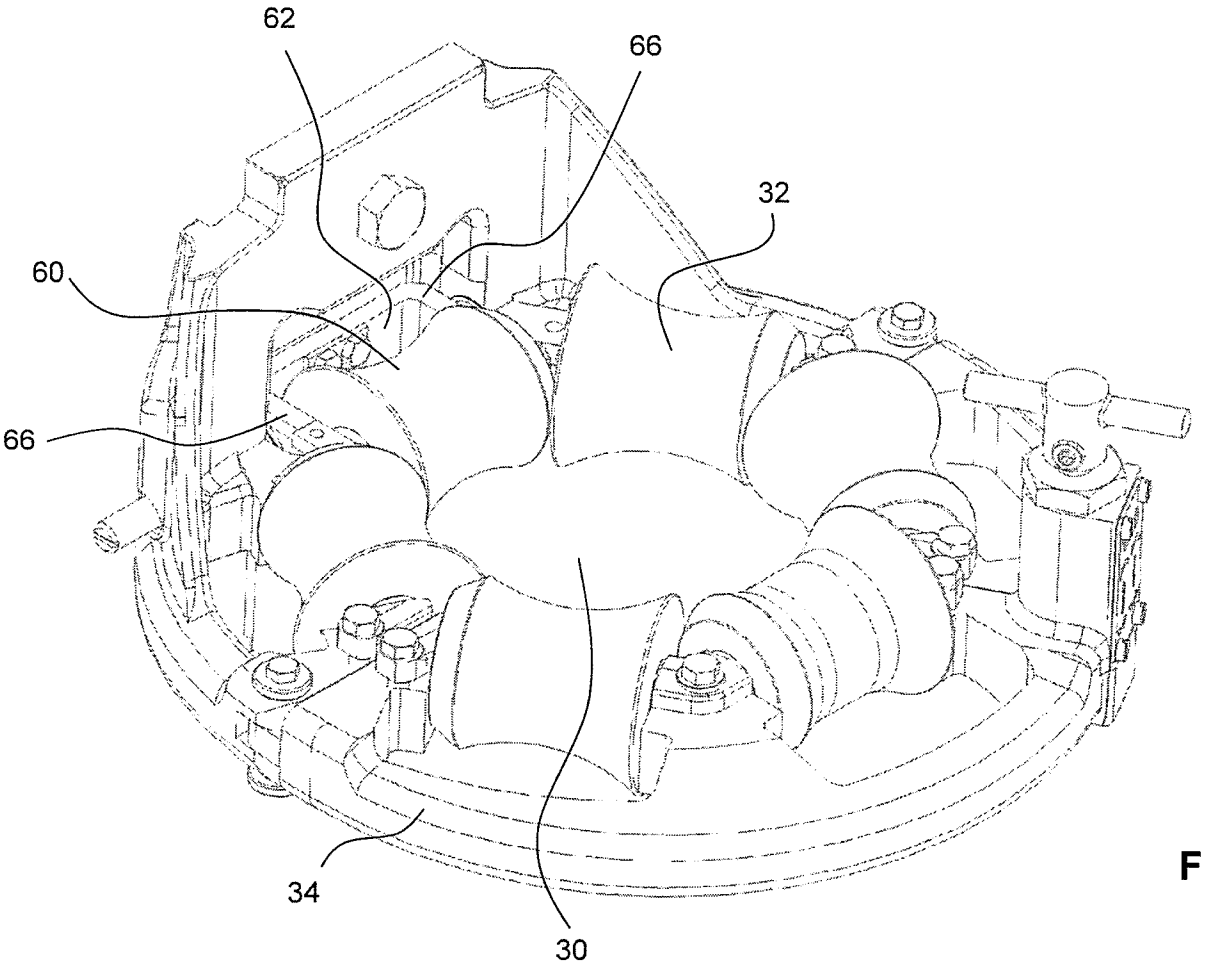
Figure 4B:
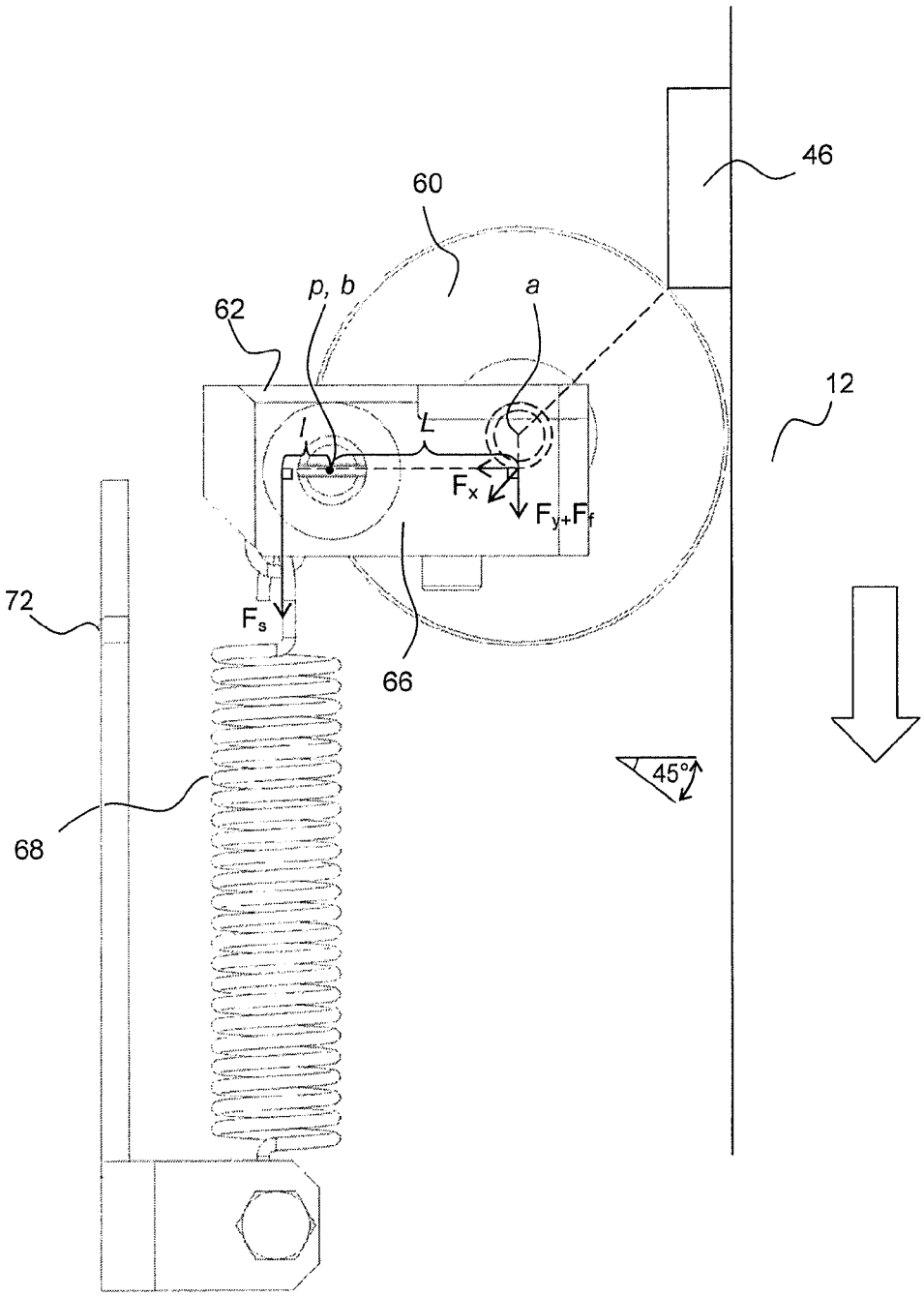
Figure 5A:
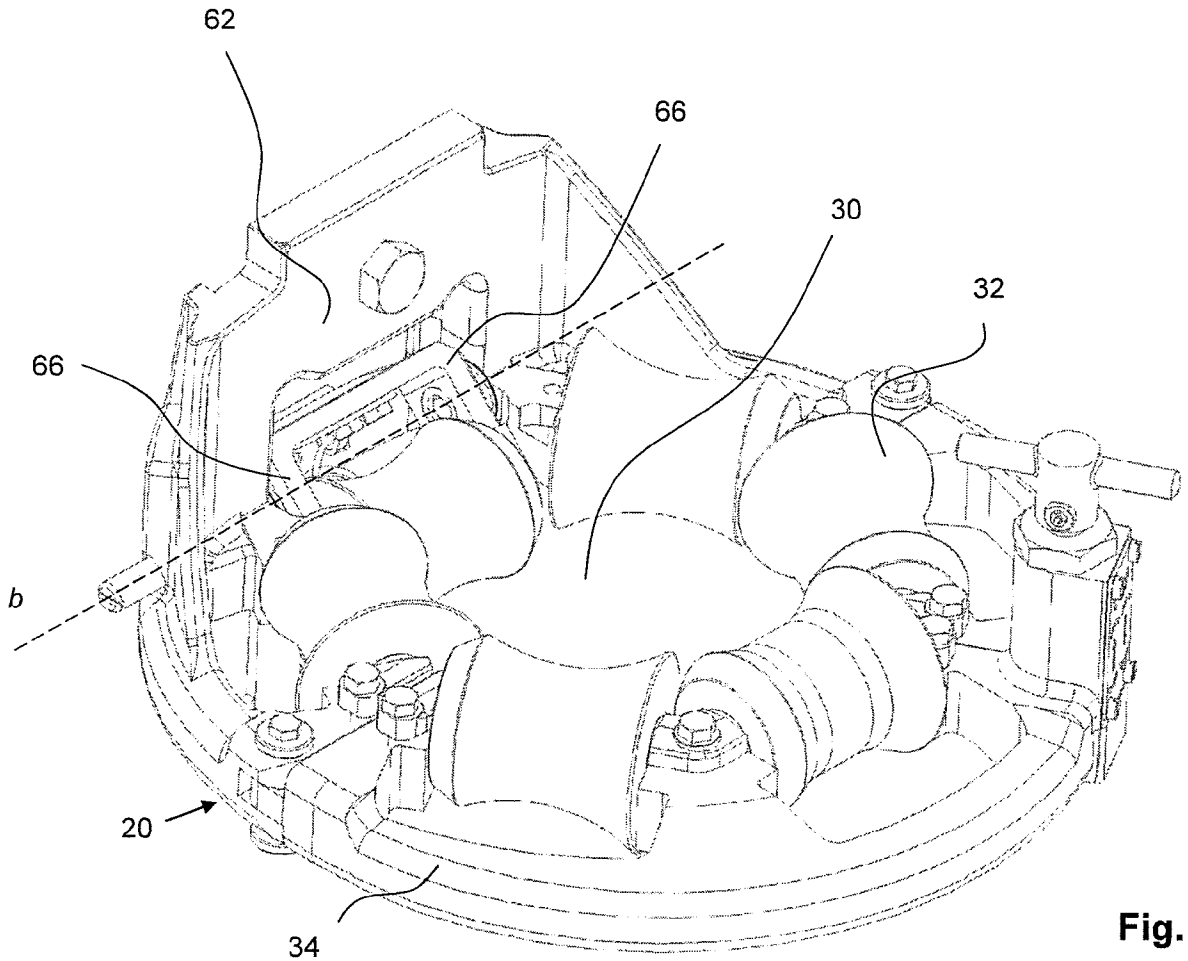
Figure 5B:
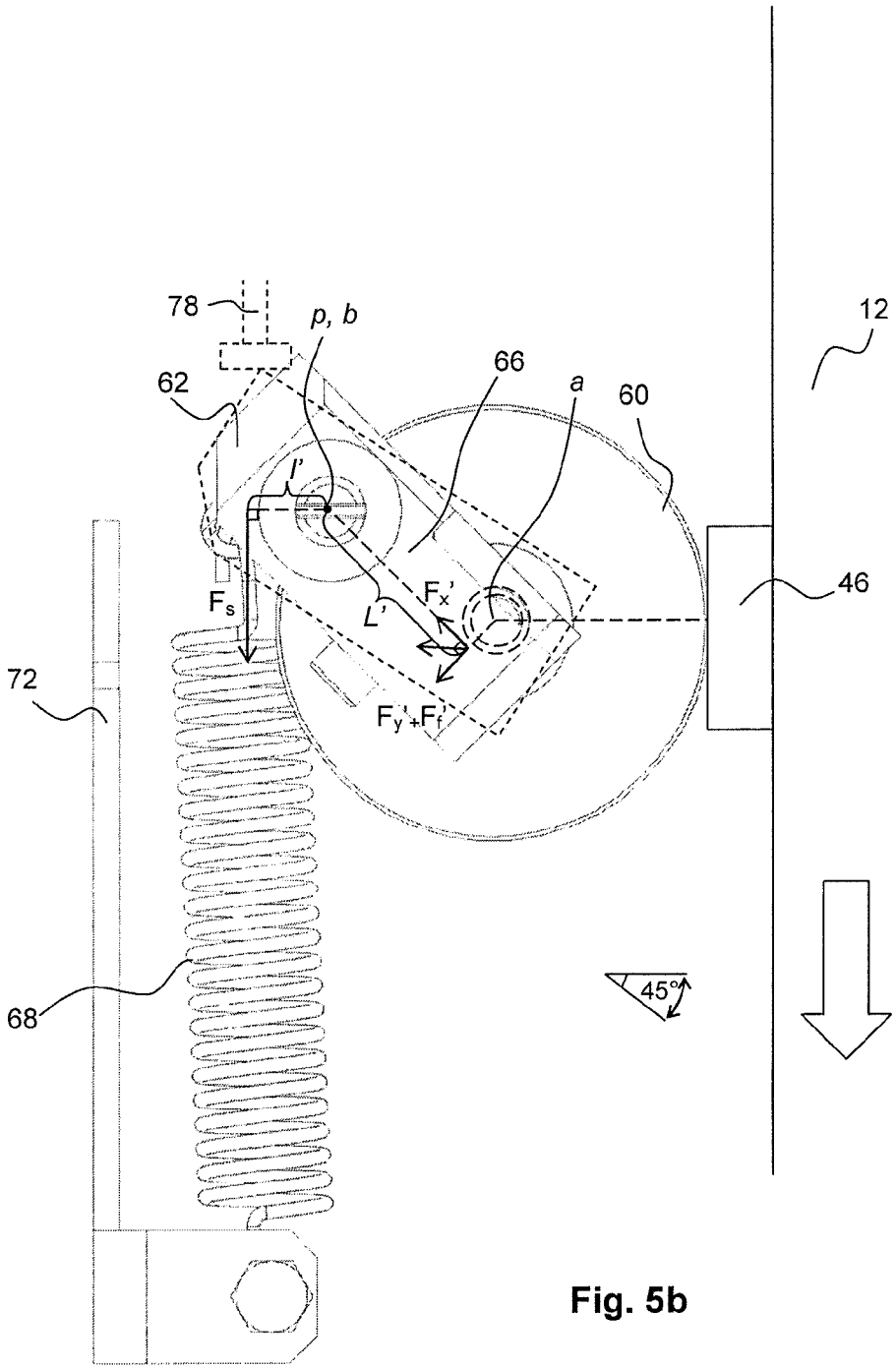
Figure 6:
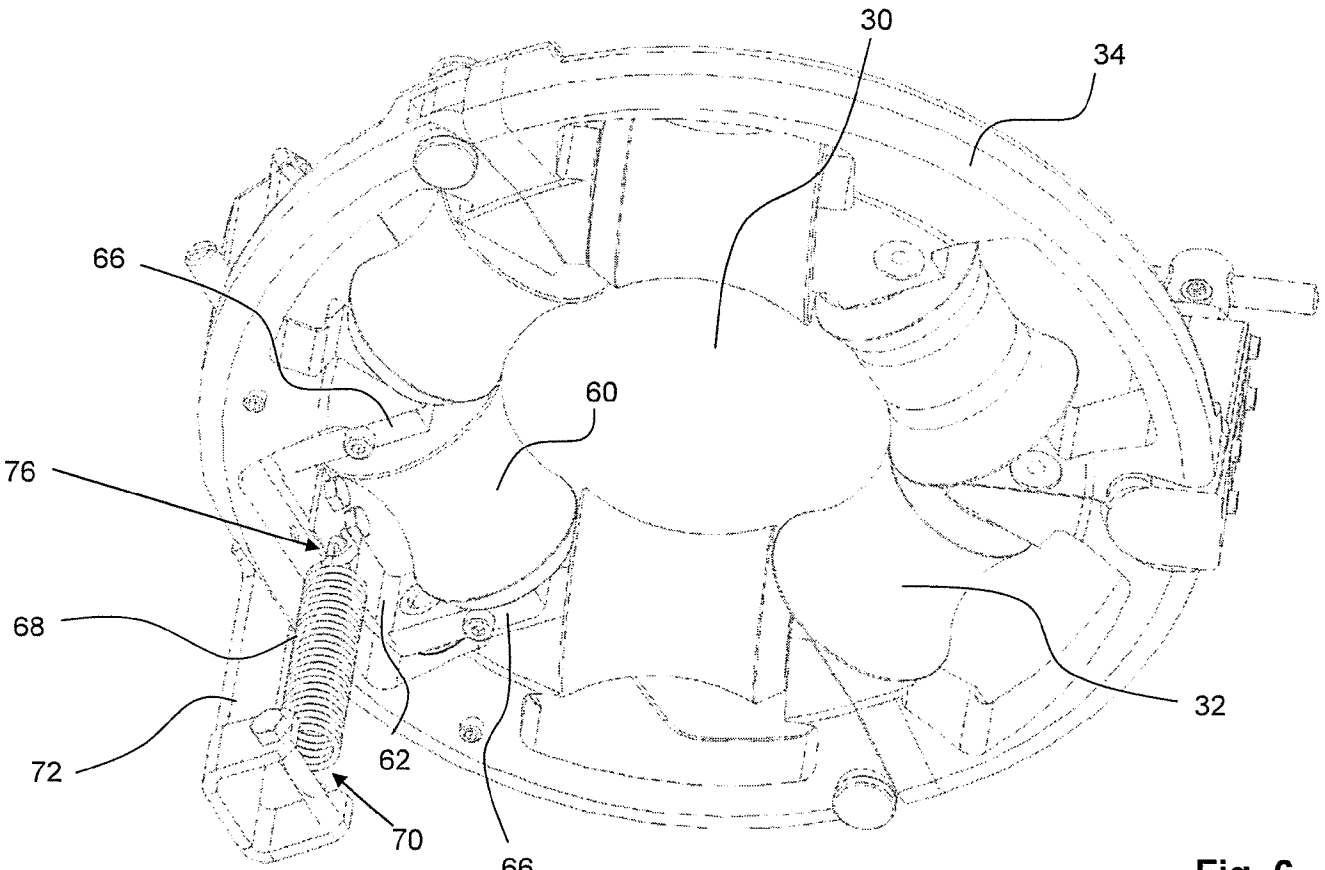
Figure 7:
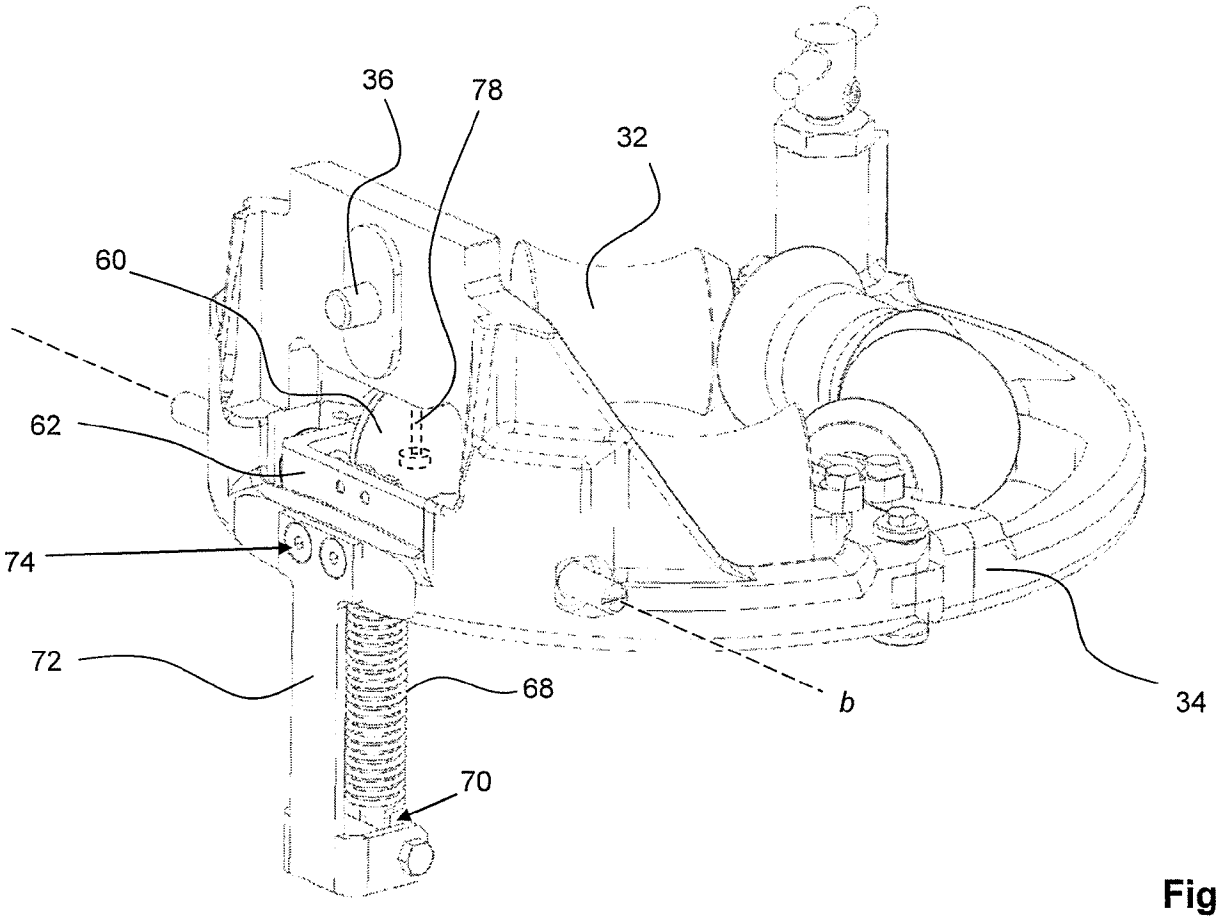

One currently preferred embodiment of the present invention will now be described in greater detail hereinbelow, with reference to the accompanying drawings in which:

FIG. 1 schematically illustrates a packing and filling machine including an apparatus according to the present invention;

FIG. 2 schematically illustrates a first embodiment of the apparatus according to the present invention seen from above;

FIG. 3 schematically illustrates one type of opening device for which the apparatus according to the present invention is intended to be employed;

FIG. 4*a* schematically illustrates a perspective view of the apparatus according to FIG. 2, in a state where one of the forming rollers is shown in its first position;

FIG. 4*b* schematically illustrates a side elevation of a number of the parts included in the apparatus of FIG. 4*a*, in said first position;

FIG. 5*a* schematically illustrates a perspective view similar to that of FIG. 4*a* where said forming roller is instead shown in its second position;

FIG. 5*b* schematically illustrates a side elevation of a number of the parts included in the apparatus of FIG. 5*a*, in said second position;

FIG. 6 schematically illustrates a perspective view of the apparatus of FIG. 2, seen from its underside; and FIG. 7 schematically illustrates a perspective view from the rear of the apparatus of FIG. 2.

The accompanying drawings are not mutually to scale.

DESCRIPTION OF EMBODIMENTS

The apparatus according to the present invention may advantageously be employed in a packing and filling machine of the type which was described by way of introduction and which is employed in, for example, the manufacture of parallelepipedic packaging containers. One such machine is shown in FIG. 1.

This machine is supplied with flexible, web-shaped packaging material. The packaging material is normally of the type which comprises a core layer of paper or paperboard and surrounding layers of thermoplastic, such as, for example, polyethylene and polypropylene. The material may also include barrier layers which protect the contents against, for example, light and oxygen. Such a barrier layer may, for example, consist of aluminium foil.

The web-shaped packaging material is supplied to the machine in the form of a magazine reel 10 from which the packaging material web 12 is unwound and led substantially upwards through the packing and filling machine with the aid of guide rollers 14. In some packing and filling machines, a sterilisation chamber is included here, where the packaging material web 12 undergoes suitable sterilisation treatment in order to extend the shelf life of the packed contents. No sterilisation chamber is shown in the Figure.

At the uppermost region of the machine, the packaging material web 12 passes a bending roller 16, and is thereafter guided substantially vertically downwards through the packing and filling machine with the aid of forming apparatuses 18, among others a forming apparatus 20 according to the present invention. With the aid of the forming apparatuses 18, the packaging material web 12 is refolded into tube form and, at the forming apparatus 20 according to the present invention, both of the longitudinal edges overlap one another and they can be sealed together with the aid of a longitudinal sealing device 22. Concentrically down through the material tube 12 extends a filler pipe 24, which extends in through the upper open end of the tube and discharges in the tube 12 immediately above the position where the tube 12 is reformed into sealed-off sections which are subsequently to become individual packaging containers. The sealing takes place with the aid of forming and sealing jaws 26 which cooperate in pairs in order to clamp together and transversely seal the packaging material tube 12. Said jaws 26 also cater for the cutting of the sealed-off sections in the sealing zones so that individual packaging containers 28 are formed.

FIG. 2 shows a first embodiment of a forming apparatus 20 according to the present invention in straight top plan view, i.e. substantially seen from the bending roller 16 in FIG. 1.

Centrally in the apparatus 20, there is disposed a material opening 30 which is substantially circular and through which the packaging material, during the reforming operation, is moved substantially continuously downwards in the packing and filling machine, i.e. the advancement takes place substantially vertically in FIG. 1.

The circular material opening 30 is formed from a number of forming rollers 32. The forming rollers 32 have a diameter which progressively increases towards their end surfaces, in order to impart to the material opening 30 the desired circular configuration. The forming rollers 32 are freely rotatably supported about shafts which, in the illustrated embodiment, have a mutual angle v of 120°. The shafts are disposed in an annular bracket 34 which in turn, through a machine anchorage 36 (visible in FIG. 7), is fixedly connected to the frame of the packing and filling machine. Each forming roller 32 includes two substantially planar end surfaces 38 as well as a working surface 40 located between the end surfaces 38 and engaging with the packaging material. Between each respective end surface 38 and the working surface 40, each forming roller displays a bevelled edge 42 and an unbevelled edge 44, and the forming rollers 32 are turned to face such that each bevelled edge 42 cooperates with an adjacent unbevelled edge 44 on a neighbouring forming roller 32.

An opening device 46 for which the apparatus 20 according to the present invention is intended to be used is illustrated in FIG. 3 placed on a packaging container 28. The opening device 46 is of the type which is injection moulded over a punched hole in the packaging material web 12. The punching and injection moulding operations take place direct in the packing and filling machine. First, a hole is punched in the packaging material web 12, then the one half of a moulding tool is placed on the one side of the web and the other half of the same moulding tool on the other side of the web. Both of the mould halves together form a cavity in which the edge of the hole is accommodated. When the mould is in position over the hole, a suitably molten polymer material is injected into the cavity for forming the opening device. This is described in greater detail in the previously mentioned publications WO 98/18609 and U.S. Pat. No. 6,386,851.

The opening device 46 is further of the type with a flange 48 against the material web from which extends a neck 50. The neck 50 defines a pouring opening which is provided with a tear-off membrane 52. The membrane 52 ensures that the opening device 46 is, before opening, completely tight and indicates that the packaging container has not previously been opened (tamper-proof). The membrane 52 is injection moulded in the same operation as the neck 50 and is an integral part thereof. In order for the membrane 52 to be able to be removed, it is provided with a pull-tab device 54. In the line between the pouring opening of the neck and the membrane 52, there is also provided a line of weakening 56 in order to facilitate pulling-off of the membrane 52. When the packaging container 28 is sold, the membrane 52 is normally covered by, for example, a screw cap. In this specification, the screw cap is not however included in the concept of 'opening device' since the packaging containers are not provided with screw caps until after final folding and discharge into a separate unit located outside the packing and filling machine. Thus, they do not pass the apparatus 20 according to the present invention. The function of the screw cap is to allow a certain reclosure once the membrane 52 has been pulled off. The screw cap has inner threads which cooperate with outer threads 58 on the neck 50.

In order to maintain the diameter of the tube when the opening device 46 projecting from the material web 12 is to pass through the material opening 30, the roller or rollers 32 of those previously mentioned which will lie in the path of the opening device are secured in the bracket 34 in a different manner than the other rollers. These forming roller or rollers are displaceable in relation to the material web 12 on passage of an opening device 46. How this problem is resolved will be described hereinbelow with reference to FIGS. 2 and 4 to 7.

In the apparatus 20 illustrated in FIG. 2, it is the rear forming roller 60 that is displaceable, i.e. that forming roller 60 which is shown uppermost in the Figure. This forming roller 60 is displaceable from a first position, see FIGS. 4*a* and 4*b*, where it is in contact with the material web 12, to a second position, see FIGS. 5*a* and 5*b*, where it is not in contact with the material web 12, but instead with the opening device 46.

Just like the remaining forming rollers 32, said forming roller 60 is rotatable about its own axis a, and this is realised in that it is rotatably journalled in an anchorage 62. Further, the forming roller 60 is pivotal about a centre of rotation designated p. Through said centre of rotation p, there extends a geometric axis b which, in for example 4*b*, runs at right angles into the plane which constitutes the plane of the drawing. The displacement of the forming roller from the first position to the second position thereby consists of a pivotal movement about said centre of rotation p. The pivotal movement is illustrated by the arrow x in FIGS. 4*b* and 5*b*. In the described embodiment, the total pivotal movement x which can be attained is approx. 45°.

The previously mentioned anchorage 62 is rotatbly journalled in the annular bracket 34 in said centre of rotation p. To this end, the annular bracket 34 has fixed shafts 64 on which the anchorage 62 is journalled. The anchorage 62 is further U-shaped and the forming roller 60 is journalled in the outer, free sections of the shanks 66 of the U-shape, while said centre of rotation p is located a distance in on said shanks 66.

Further, the apparatus 20 according to the first embodiment of the present invention includes an elastic element 68. In this case, the elastic element 68 consists of a tension spring. This spring 68 is, in a first end 70, secured in the annular bracket 34 by means of a spring anchorage 72 projecting downwardly from the underside of the annular bracket 34. The spring anchorage 72 is fixedly connected to the annular bracket 34 by a screw union 74. In addition, the spring 68 is, in its other end 76, fixedly secured in the pivotal anchorage 62, at the central section of the U-shape between the shanks 66. This anchorage is best seen in FIG. 6.

Thus, the spring 68 is fixedly secured in the anchorage 62 on a first side of said centre of rotation p, while the forming roller 60 is rotatably journalled in the anchorage 62 on a second side of said centre of rotation p. This is best seen in FIGS. 4*b* and 5*b*.

When the forming roller 60 is located in its first position (see FIG. 4*b*) in contact with the material web 12, the spring anchorage 72 and the spring 68 run parallel with one another and are directed substantially at right angles to the pivotal anchorage 62. The shanks 66 of the anchorage extend in their turn, in this position, substantially at right angles to the material web 12.

FIG. 4*b* shows the contour of an opening device 46 on the material web 12, and it is located in a position where it just comes into contact with the displaceable forming roller. The tube advancement direction runs from above and downwards in the Figure and is illustrated by means of an arrow. The opening device 46 will urge against the forming roller 60 and it is this compressive force that initiates said pivotal movement. As shown in the Figure, the force from the opening device 46 has a component in the vertical direction, designated $F_y$, and a component in the horizontal direction, designated F. The term 'vertical direction' is here taken to signify a direction which corresponds to the advancement of the material web, and the term 'horizontal direction is here taken to signify a direction transversely of the advancement direction of the material web, i.e. that direction towards which the material tube 12 would strive to expand if the forming rollers did not resist. The force component $F_X$ cannot initially influence the pivotal movement, while the force component $F_y$ plus the force contribution from the natural weight of the forming roller gives a torque about the centre of rotation p with the aid of the fulcrum L. The torque which the counterforce in the spring, F, gives with the aid of its fulcrum l is not capable in this position of retaining the anchorage 62 in its horizontal position, but the spring 68 is extended and the anchorage 62 rotates a distance about the axis of rotation b. When this takes place, the forming roller 60 is pivoted away from the material opening 30 to its second position. This is seen in FIGS. 5*a* and 5*b*.

FIG. 5*b* shows the second position where the pivotal movement has reached its end point and where the opening device 46 is located in register with the forming roller 60. From the opening device 46 having come into contact with the forming roller 60, the contact is maintained, but the spring force is suitably adapted so that the forming roller does not act on the opening device 46 with any appreciable force, i.e. when the opening device 46 has reached the second position, the forming roller 60 is not capable of pressing so hard on the opening device 46 that the material tube 12 is deformed. A certain inward bulging of the material tube 12 may occur, but it should preferably be so slight that no deformation of the paper layer in the packaging material 12 occurs. However, the forming roller 60 should be able to resist sufficiently so that the material tube 12 is not permitted to bulge outwards from the material opening 30. A certain outward bulging of the material tube 12 may occur, but this should preferably be extremely slight. The earlier force components $F_X$ and $F_y$ acting in the apparatus have changed position from the first position to the second position, and in the second position they are illustrated for purposes of simplicity as $F_X'$ and $F_y'$. The force contribution from the natural weight of the forming roller is designated $F_f'$. The force components $F_y'$ and $F_f'$ which give the torque about the centre of rotation p through the fulcrum L' should, in other words, in this position preferably be equal to the spring force $F_s'$ multiplied by its fulcrum l'.

In the second position, as was described above, the anchorage 62 has pivoted about the axis of rotation b and the spring 68 has been extended. The spring 68 has then also changed direction and is no longer parallel with the spring anchorage 72 but slightly angled in relation thereto.

Shortly after the moment shown in FIG. 5*b*, the forming roller 60 begins to return to the first position, the starting position. Initially, the return takes place cautiously, according as the forming roller 60 reduces its contact with the opening device 46, but in that position where the forming roller 60 completely loses contact with the opening device 46 and as a result there is no longer any other force component than $F_f$, i.e. the contribution from the natural weight of the forming roller, in the vertical direction, the spring 68 contracts again, which has as a result that the anchorage 62 snaps back up so that the forming roller 60 is once again back at its first position abutting the material web 12, as shown in FIGS. 4*a* and 4*b*. The torque which the natural weight of the forming roller gives about the centre of rotation p in the first position is thereby insufficient to extend the spring 68.

The forming roller 60 then maintains its first position until the next opening device arrives at the material opening 30. Then, the forming roller 60 is once again displaced from its first position to its second position, in the same manner, and when the contact of the opening device with the forming roller 60 disappears, the forming roller 60 returns then to its first position.

It should be understood that a plurality of parameters influences the function of the arrangement such as, for example, the rigidity of the material web and its speed of advancement; the pretensioning, length and spring constant of the spring; the natural weight and size of the forming roller, as well as the length of the fulcrum from the centre of rotation to the centre of the forming roller, as well as the length of the fulcrum from the centre of rotation to the anchorage point of the spring, respectively.

In addition to that disclosed previously, it might be mentioned that the spring 68 should not be more powerful (stiffer) than that the forming roller 60 can pivot aside immediately when an opening device 46 arrives and jolts against the forming roller 60. However, the spring 68 should not be weaker (slacker) than that the U-shaped anchorage 62 returns to the horizontal position once the opening device 46 has passed through the material opening 30 and is no longer in contact with the forming roller 60. If the return is too slow or does not occur at all, the material tube 12 is allowed to flex out into the gap and the material opening 30 will be too large. On the other hand, if the return is too fast, the material tube 12 will not have time to flex out appreciably. In order to increase the striving of the forming roller 60 to return to the horizontal position, the apparatus may further include an arrest member 78 for restricting the pivotal movement of the forming roller. Such an arrest member is schematically illustrated (and by broken lines) in FIGS. 5*b* and 7. The arrest member 78 thus fulfils the function of preventing the forming roller from assuming the maximum position which is illustrated in FIG. 5*b*, since the pivotal movement is arrested earlier, as illustrated by broken lines in the Figure. With the aid of such an arrest member 78, the possibilities of the tube to outwardly bulge in the area of the forming roller 60 are limited.

In a second embodiment of the present invention, the annular bracket and the forming rollers are of the same nature as in the previously described embodiment. That which distinguishes this embodiment is the solution as to how the forming roller or rollers which lie in the path of the opening device through the material opening are displaced so as not to be in the way. In this embodiment, the forming roller is rotatably journalled in an anchorage which is in communication with a displacement means. The displacement means is of the type that can displace an object from one position to another, for example a servomotor or a pneumatic piston. The displacement means is in turn in communication with means for detecting the opening device. Such a detecting means may be some type of sensor which is rehearsed to detect an opening device which, as a result of the advancement of the tube, steadily approaches the material opening, for example a photocell or the like. The sensor communicates with a control means that controls the movement of the displacement means. Preferably, a signal is emitted on displacement from the first position to the second position immediately before the opening device has arrived at the material opening. Similarly, a signal on displacement back to the first position is emitted when the opening device has passed through the material opening. By such means, the forming roller will not come into contact with the opening device and the time during which a gap occurs in the material opening will be so short that no substantial outward flexing of the material tube ever has time to occur.

In one alternative solution of the second embodiment, the detecting means may be a sensor already included in the packing and filling machine, viz. that sensor which reads off the position of the so-called register mark. This mark is employed in today's machines in order to ensure that the decorative artwork of the material web is correctly positioned in relation to each respective packaging container. By reading-off this mark, indirect intelligence is obtained as to where the opening devices are located in relation to the forming apparatus, and by such means it is possible to decide when it is time to displace the forming roller.

While the present invention has merely been described with respect to a couple of preferred embodiments, it should be obvious to the skilled reader of this specification that the present invention is not restricted thereto, but that a plurality of variations and modifications are conceivable without departing from the scope of the appended Claims.

Naturally, the opening device 46 may be of other type than that which has been described in the foregoing, for example of the type including a folding lid or of the type which has no tear-off membrane and is instead provided with a screw cap or a snap-on cap already from the outset.

In the illustrated example, it is one forming roller 60 which is displaceable. Naturally, it is possible that more than one forming roller is displaceable, depending on the size of the forming rollers in relation to the size of the opening device which is to be allowed to pass.

It should also be understood that the spring arrangement which is described in the foregoing may of course be of a different nature.

What is claimed is:

1. An apparatus for reforming of a material web of flexible packaging material into tube form by rotatable forming rollers which define a material opening, wherein said forming rollers are freely rotatably supported about shafts disposed in an annular bracket which is fixedly connected to a frame of a packaging and filling machine through an anchorage, and at least one of the forming rollers, which will lie in a movement path of an opening device disposed on the material web as the opening device passes through said material opening, is displaceable in relation to the material web, said opening device protruding from the material web and defining an openable closure, while others of the forming rollers, which will not lie in the movement path of the opening device as the opening device passes through the material opening, are not displaceable in relation to the material web.

2. The apparatus as claimed in claim 1, wherein said at least one of the forming rollers is displaceable from a first position where it is in contact with the material web to a second position where it is not in contact with the material web.

3. The apparatus as claimed in claim 2, wherein said at least one of the forming rollers is rotatable about its own axis and pivotally disposed about an axis which extends through a centre of rotation, and wherein the displacement of the at least one of the forming rollers from the first to the second position thereby consists of a pivotal movement about said centre of rotation and axis.

4. The apparatus as claimed in claim 3, wherein said pivotal movement is initiated in that said opening device comes into contact with and urges against the at least one of the forming rollers.

5. The apparatus as claimed in claim 4, wherein said pivotal movement is permitted and regulated by an elastic element in communication with the at least one of the forming rollers, and wherein the at least one of the forming rollers is, as a result of the elastic tensioning, disposed to completely return from the second to the first position when the contact with the opening device ceases.

6. The apparatus as claimed in claim 3, wherein the at least one of the forming rollers is pivotally disposed about said centre of rotation by the anchorage, wherein said anchorage is rotatably journalled in the annular bracket in said centre of rotation, wherein the elastic element is secured in the annular bracket as well as in the anchorage on a first side of said centre of rotation, and wherein said at least one of the forming rollers is rotatably journalled in the anchorage on a second side of said centre of rotation.

7. The apparatus as claimed in claim 6, wherein the anchorage is U-shaped, wherein the at least one of the forming rollers is journalled in the outer, free sections of the shanks of the U-shape, wherein the elastic element is secured in the central section of the U-shape between the shanks, and wherein the annular bracket includes fixed shafts which are journalled in said centre of rotation of the anchorage.

8. The apparatus as claimed in claim 3, wherein the second position of the at least one of the forming rollers is defined by an arrest member which restricts the pivotal movement of the at least one of the forming rollers.

9. The apparatus as claimed in claim 4, wherein said at least one of the forming rollers is suspended so that it will be displaceable when a force or force component in the direction of advancement of the material web initially acts on the at least one of the forming rollers, the force or force component occurring on contact between the at least one of the forming rollers and the opening device, while the at least one of the forming rollers maintains its position if it is only affected by a force or force component which derives from the material web and is directed transversely of the direction of advancement of the material web.

10. The apparatus as claimed in claim 1, wherein the elastic element is a tension spring.

11. The apparatus as claimed in claim 1, wherein said at least one of the forming rollers is in communication with displacement means for displacing the at least one of the forming rollers which are in communication with means for detecting said opening device, and wherein the at least one of the forming rollers is disposed to be displaced by said displacement means when said opening device approaches the material opening.

12. The apparatus as claimed in claim 11, wherein said displacement means displace the at least one of the forming rollers from the first position to the second position immediately before the opening device reaches the material opening, and wherein said displacement means displace the at least one of the forming rollers back to the first position when the opening device has passed through the material opening.

13. A web reforming apparatus for reforming a web of flexible packaging material into a tube, the web reforming apparatus forming part of a packing and filling machine in which the web of flexible packaging material formed into the tube is filled and sealed at longitudinally spaced apart locations to form individual packaging containers each outfitted with an opening device, said opening device protruding from the web of material and defining an openable closure, the web reforming apparatus comprising:

a bracket fixedly connected to a frame of the packing and filling machine;

a plurality of forming rollers freely rotatably supported on respective shafts;

the shafts being disposed in the bracket so that the forming rollers are supported on the bracket;

each forming roller possessing an outer diameter progressively increasing from a center region of the forming roller towards axial end surfaces of the forming roller;

the plurality of forming rollers being arranged relative to each other to surround a material opening through which passes the flexible packaging material as outer surfaces of the forming rollers contact the web of packing material and reform the web into the tube; and the shaft of at least one of the forming rollers being supported on the bracket in a manner permitting the at least one of the forming rollers to move relative to the bracket away from the web passing through the material opening as one of the opening devices is passing through the material opening, the shaft of others of the forming rollers being supported on the bracket in a manner not permitting the others of the forming rollers to move relative to the bracket away from the web passing through the material opening as the one of the opening devices is passing through the material opening.

14. The apparatus as claimed in claim 13, wherein the at least one of the forming rollers is pivotally movable about an axis which extends through a center of rotation.

15. The apparatus as claimed in claim 14, further comprising an elastic element operatively associated with the at least one of the forming rollers to elastically urge the at least one of the forming rollers towards the material opening.

16. The apparatus as claimed in claim 13 further comprising an arrest member which restricts the pivotal movement of the at least one of the forming rollers in a direction away from the material opening.

* * * * *